US010876297B1

(12) United States Patent
Poma et al.

(10) Patent No.: US 10,876,297 B1
(45) Date of Patent: Dec. 29, 2020

(54) GLASS RAILING ANCHOR SYSTEM

(71) Applicants: Justin G. Poma, Port Saint Lucie, FL (US); Jason F. Poma, Palm City, FL (US); Francesco Poma, Port Saint Lucie, FL (US)

(72) Inventors: Justin G. Poma, Port Saint Lucie, FL (US); Jason F. Poma, Palm City, FL (US); Francesco Poma, Port Saint Lucie, FL (US)

(73) Assignee: Poma & Sons, Inc., Palm City, FL (US)

( * ) Notice: Subject to any disclaimer, the term of this patent is extended or adjusted under 35 U.S.C. 154(b) by 650 days.

(21) Appl. No.: 15/683,410

(22) Filed: Aug. 22, 2017

(51) Int. Cl.
*E04F 11/18* (2006.01)
*E04H 9/14* (2006.01)

(52) U.S. Cl.
CPC ..... *E04F 11/1812* (2013.01); *E04F 11/1853* (2013.01); *E04F 11/1836* (2013.01); *E04H 9/14* (2013.01)

(58) Field of Classification Search
CPC ... E04F 11/18; E04F 11/1812; E04F 11/1851; E04F 11/1853
USPC ..... 256/24
See application file for complete search history.

(56) References Cited

U.S. PATENT DOCUMENTS 4,390,165 A 6/1983 Murdock
4,391,069 A 7/1983 Vermillion
4,793,110 A * 12/1988 Tucker ..... E02D 27/00 248/188.4
6,618,953 B2 * 9/2003 Izumi ..... E04F 11/1812 33/521
6,964,410 B1 * 11/2005 Hansen ..... E04F 11/1812 256/24
7,814,711 B2 10/2010 Milligan et al.
8,181,405 B2 * 5/2012 Nash ..... E04F 11/1851 52/127.8
8,776,477 B2 * 7/2014 Sprague ..... E04F 11/1851 52/126.3
8,820,721 B1 * 9/2014 Poma ..... E04H 9/14 256/24
9,127,474 B2 * 9/2015 Tinwala ..... E04H 17/16
9,470,038 B2 * 10/2016 Ona-Gonzalez .... E05D 15/0604
(Continued)

FOREIGN PATENT DOCUMENTS

AT 520191 A4 * 2/2019 ..... E04F 11/1812
DE 102017125020 A1 * 4/2019 ..... E04F 11/1853
(Continued)

*Primary Examiner* — Jonathan P Masinick
(74) *Attorney, Agent, or Firm* — Dale P. DiMaggio; Malin Haley DiMaggio & Bowen, P.A.

(57) ABSTRACT

An improved glass railing anchor system for multiple glass panels in high-rise buildings which can experience hurricane strength winds, and which includes an elongated base member having two hollow wall sections which create a channel for receiving the glass panels. Aligned with and beneath the hollow wall sections are integral keyways which anchor assembly's which include mounting plates, elevated rails and a central mounting post that also elevate the base member to allow for drainage. The anchor assemblies are slidable and can be selectively positioned for easy and secure installation. The base member, hollow wall sections, keyway and drainage areas can be integrally incorporated into a unitary device.

16 Claims, 11 Drawing Sheets

(56) References Cited

U.S. PATENT DOCUMENTS

| | | | | |
|---|---|---|---|---|
| 9,617,736 | B2 * | 4/2017 | Zhou | E04F 11/1853 |
| 9,657,760 | B2 * | 5/2017 | Giacometti | F16B 2/14 |
| 9,683,402 | B2 * | 6/2017 | Abdul Lathief | E06B 3/66304 |
| 2011/0219722 | A1 * | 9/2011 | Feigl | E04F 11/1851 52/705 |
| 2012/0043034 | A1 | 2/2012 | Feigl | |
| 2013/0248792 | A1 * | 9/2013 | Bangratz | E04F 11/1851 256/24 |
| 2017/0101784 | A1 * | 4/2017 | Gonzato | E04F 11/1812 |
| 2017/0292274 | A1 * | 10/2017 | Downs | E04F 11/1812 |

FOREIGN PATENT DOCUMENTS

| | | | | |
|---|---|---|---|---|
| DE | 102017125674 | A1 * | 5/2019 | E04F 11/1853 |
| WO | WO-2015145373 | A1 * | 10/2015 | E04F 11/1853 |
| WO | WO-2015145374 | A1 * | 10/2015 | E04F 11/1836 |

* cited by examiner

GLASS RAILING ANCHOR SYSTEM

CROSS REFERENCE TO RELATED APPLICATIONS

N/A.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

1. Field of the Invention

This invention relates generally to an improved anchor system for glass railings, and more particularly, to a glass railing anchor system that uses adjustable sliding anchor assemblies having an anchor post, mounting plate and two elevated rails, the anchor assemblies being selectively positioned along a aluminum base bottom rail. The improved anchor assemblies provide for manufacturing, assembly and installation of glass railing, enhance the structural support and stability of the railings, and improve the distribution of tensile and compressive loads on the entire railings and anchor and anchor system, allowing greater use of the glass railing anchor system in high velocity wind zones, such as high velocity hurricane zones ("HVHZ").

2. Description of the Background Art

The instant improved anchor system for glass railings is an engineering evolution improving upon the earlier system of the same inventors herein, and as shown, described and claimed in U.S. Pat. No. 8,820,721, and assigned to Poma & Sons, Inc.

U.S. Pat. No. 8,820,721 provides for a discussion of the relevant prior art, shortcomings in conventional glass railing anchor systems, and details the Applicants' prior creative system. U.S. Pat. No. 8,820,721 is expressly incorporated by reference herein, and the instant application and inventions are a substantial advance in the engineering designs in terms of both structural integrity, production, installation, maintenance and life span of glass railings.

Therefore, the instant invention improves upon Applicants' prior glass railing anchor system in several advantageous aspects as disclosed and claimed herein.

DETAILED DESCRIPTION OF THE INVENTION

Figure 1:
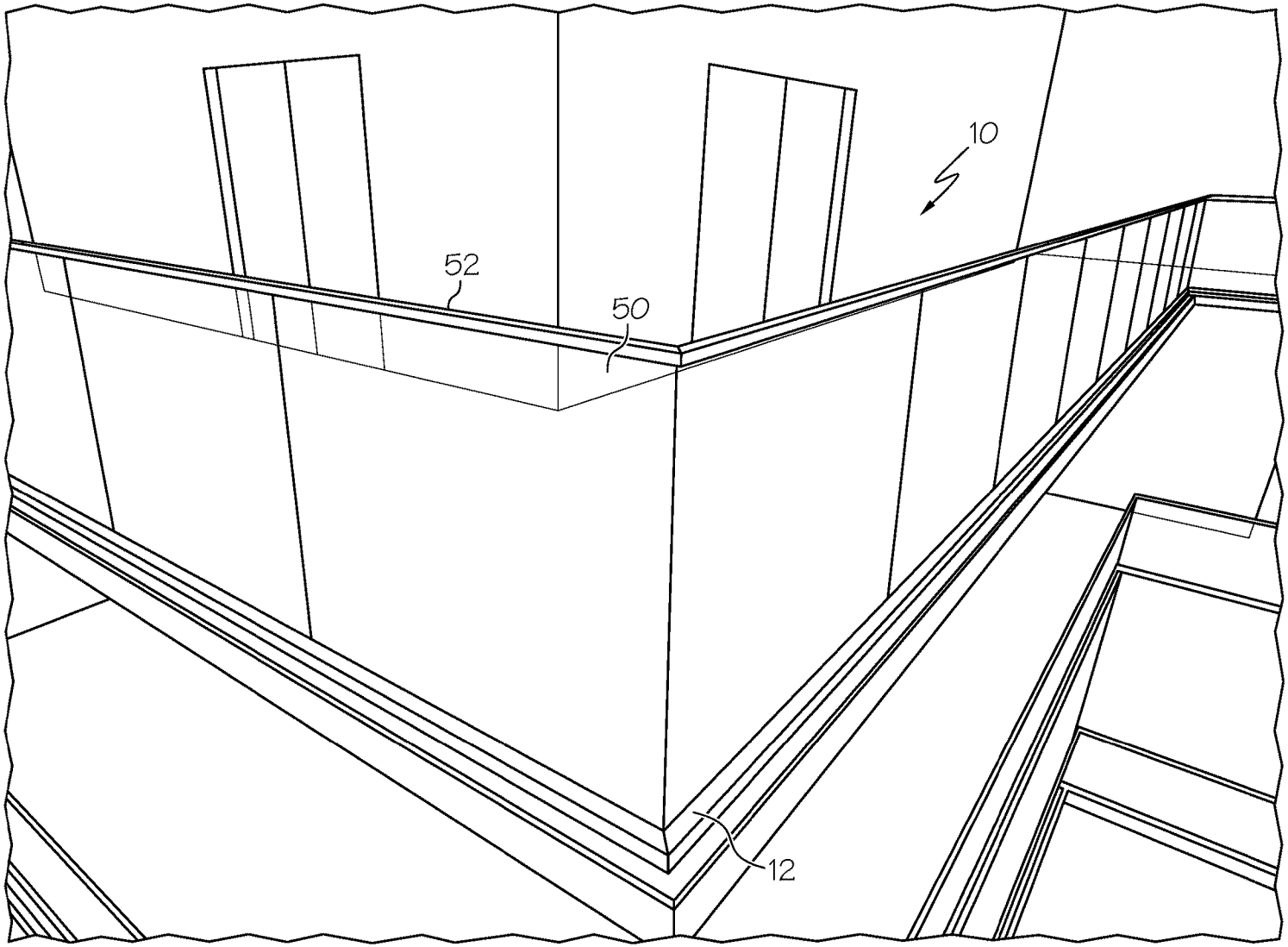
FIG. 1 is a perspective view of the glass railing system installed on a balcony in accordance with the preferred embodiment of the instant invention.

With reference to the drawings, FIGS. 1-12 depict the preferred and alternative embodiments of the instant invention which is generally referenced as a glass railing anchor system and, or by numeric character 10. The instant invention 10 comprises a glass railing anchor system that is designed to withstand the forces realized in high velocity hurricane zones ("HVHZ") and comparable high wind zones. The glass railing anchor system 10 is adapted for installation on balconies of high rises, as shown in FIG. 1. The instant invention 10 may also be installed on balconies of buildings in high wind zones, such as on the beach or on decks. Referring to FIG. 1, the glass railing anchor system 10 generally comprises an aluminum base 12 and at least one panel 50 supported by the base 12, and may also include a variety of caps 52. The instant invention 10 is described in more detail herein below.

With reference to FIGS. 1 to 12, the glass railing anchor system 10 comprises an elongated aluminum base 12 that is extruded to form two opposing, raised and parallel walls 16, 18 that define a glass panel receiving channel 20, gasket receiving channels 15, a gasket 70 for each side of a glass panel 50, a hollow channel 28, 30 in each wall, and a pair of slidable anchor receiving keyways 22, 32 in the base 12 below the walls 28, 30, on opposite sides of the base 12 for receiving upper elongated rails 82 of sliding anchor post assembly 80.

Sliding anchor post assembly 80, includes the upper elevated and elongated rails 82, rods 88, mounting plate 84, and central mounting post 86, as particularly shown in FIGS. 4, 5, 9 & 11. Elongated rails 82 are elevated above mounting plate 84 by rods 88, which can be hardware pins, bolts, adjustable screws or the like. Elongated rails 82 are mounted on opposite sides of mounting plate 84, and each rails is supported, and elevated, by two rod members 88. Elongated rails are dimensioned to be the same length as the mounting plate 84.

The improved sliding anchor post assembly 80 provides substantially enhanced structural support for the glass railing extruded base 12. Mounting plate 84 supports the entire lowermost horizontal surface 14, and eliminates any gap, airspace, or void between mounting plate 84 and lowermost horizontal surface 14. The elongated rails 82 also provide further substantially enhanced structural support for the glass railing extruded base 12, as they provide significantly more surface area that supports the extruded base within the keyways 22,32.

The central anchor post 86 also provides substantially improved structural support, as it is relatively large in diameter and centered within mounting plate 84 for a single post embedded within a concrete slab. The entire sliding anchor post assembly 80 is designed as a single integrated unit, which slidingly engages the glass railing extruded base 12 for selective placement in the installation process.

Figure 2:
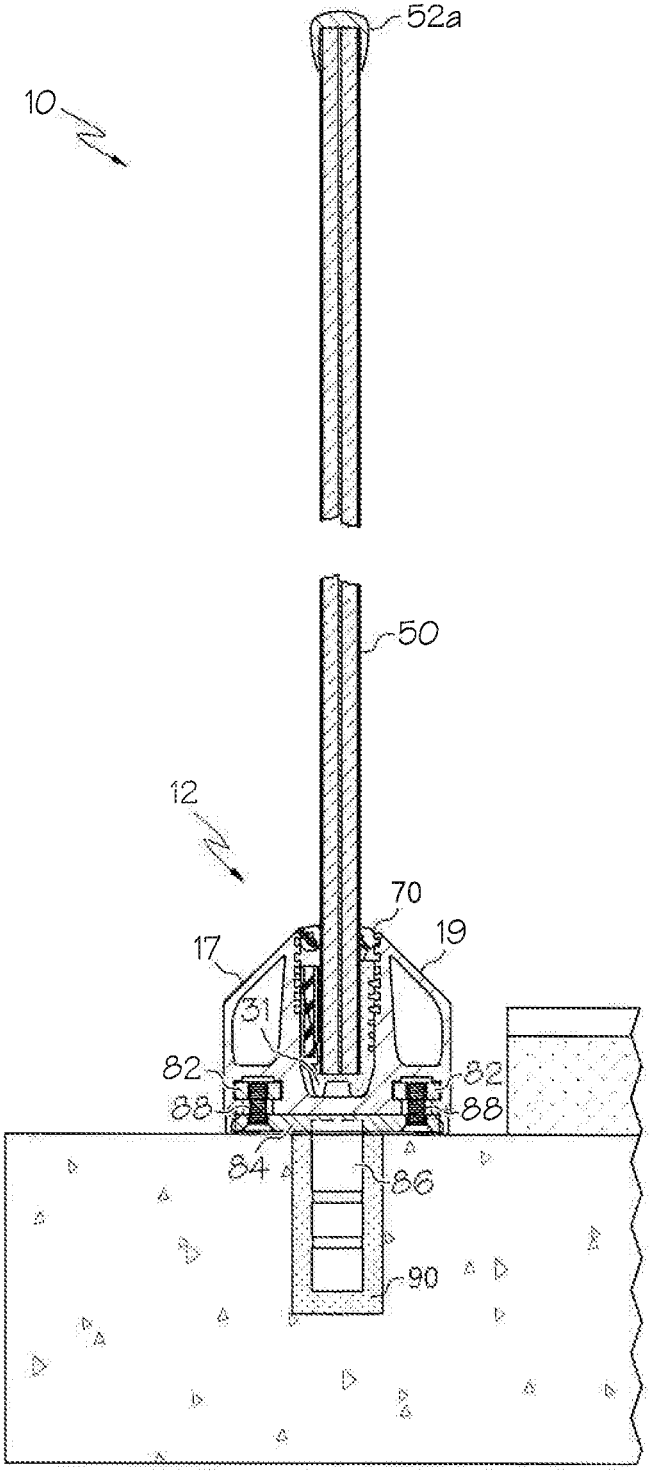
FIG. 2 is a cross sectional side view of the glass railing system as installed on a balcony in accordance with the preferred embodiment of the instant invention.
Figure 5:
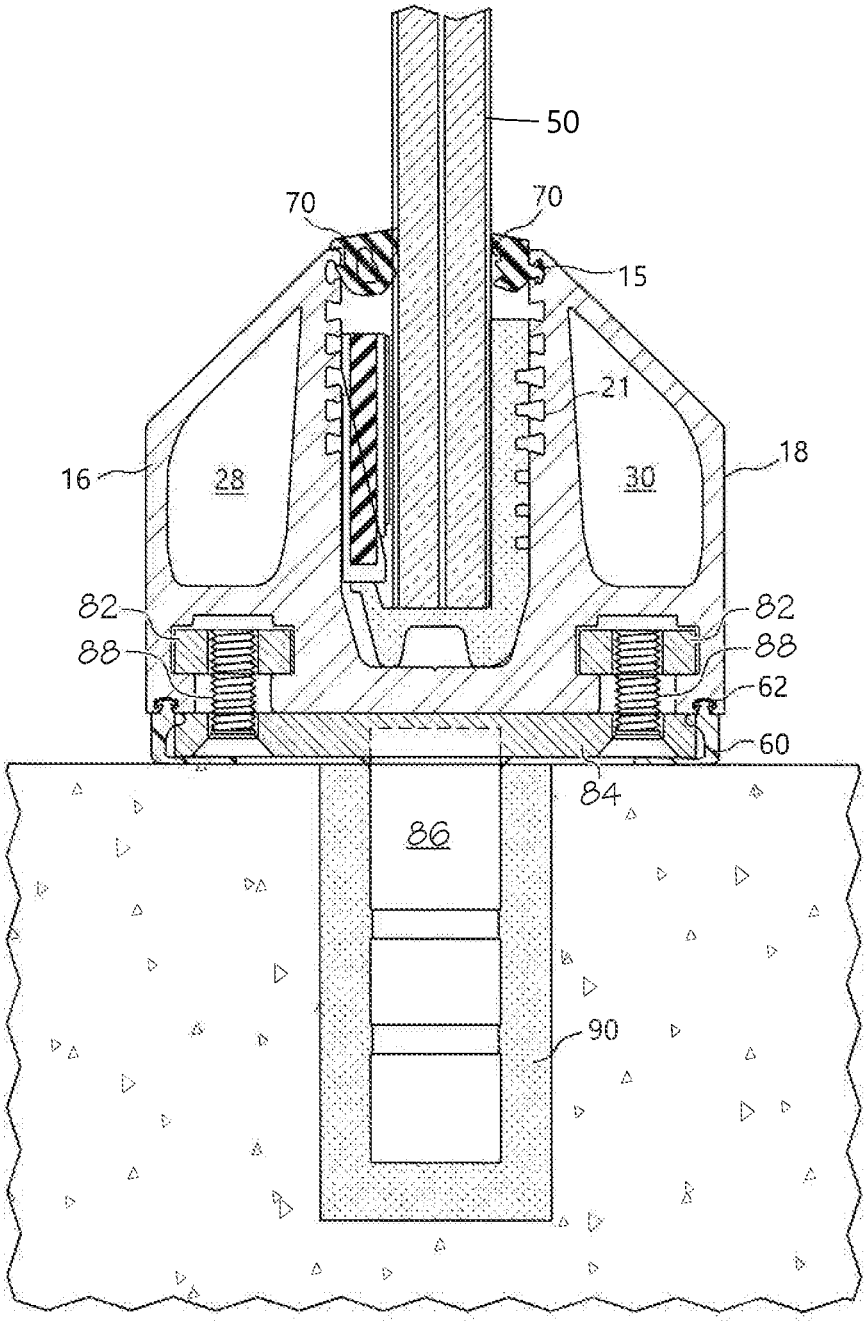
FIG. 5 is a cross sectional view of the glass railing system with a glass panel as installed in accordance with the preferred embodiment of the instant invention.
Figure 6A:
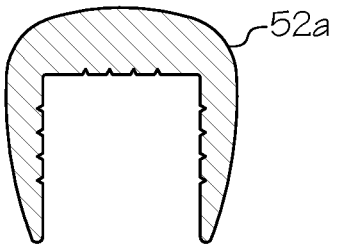
FIGS. 6A-6D are cross sectional views of various top caps of the glass railing system in accordance with the preferred embodiment of the instant invention.
Figure 6B:
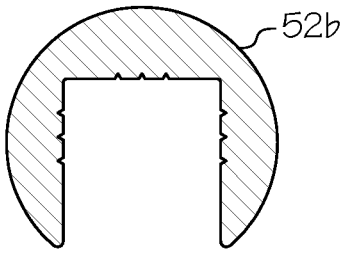
Figure 6C:
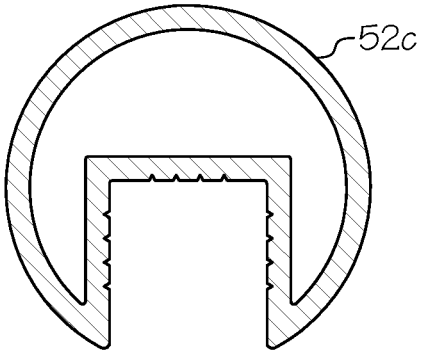
Figure 6D:
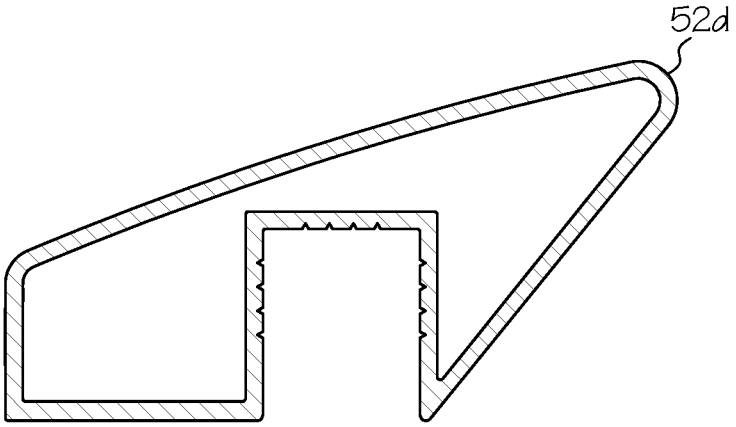
Figure 7A:
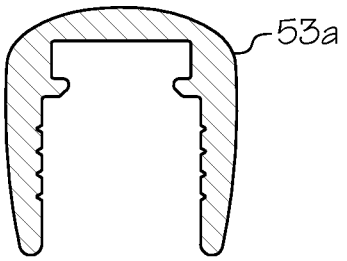
FIGS. 7A-7D are cross sectional views of alternative top caps of the glass railing system in accordance with the preferred embodiment of the instant invention.
Figure 7B:
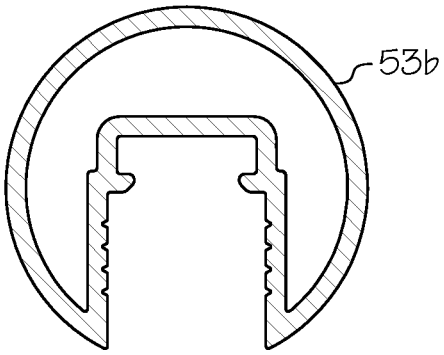
Figure 7C:
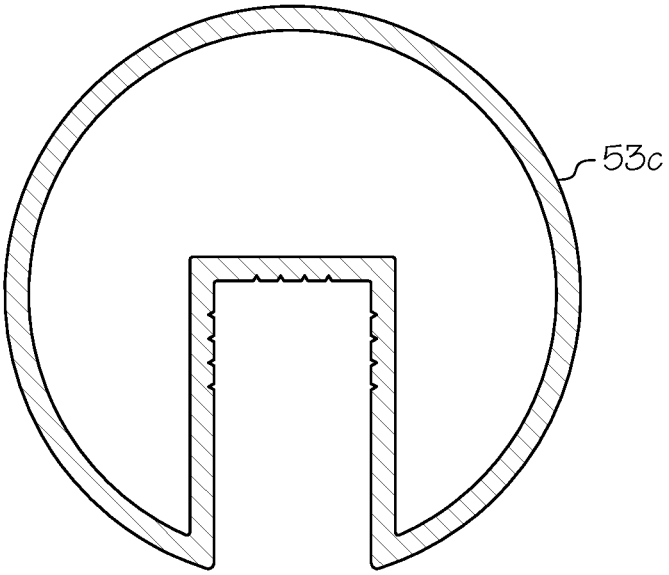
Figure 7D:
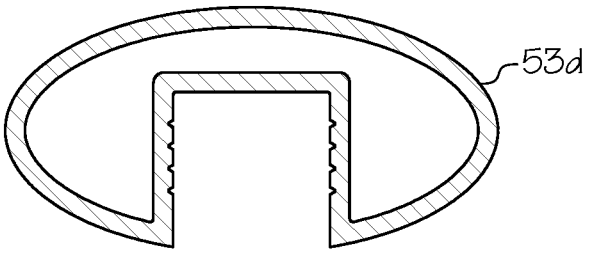
Figure 8A:
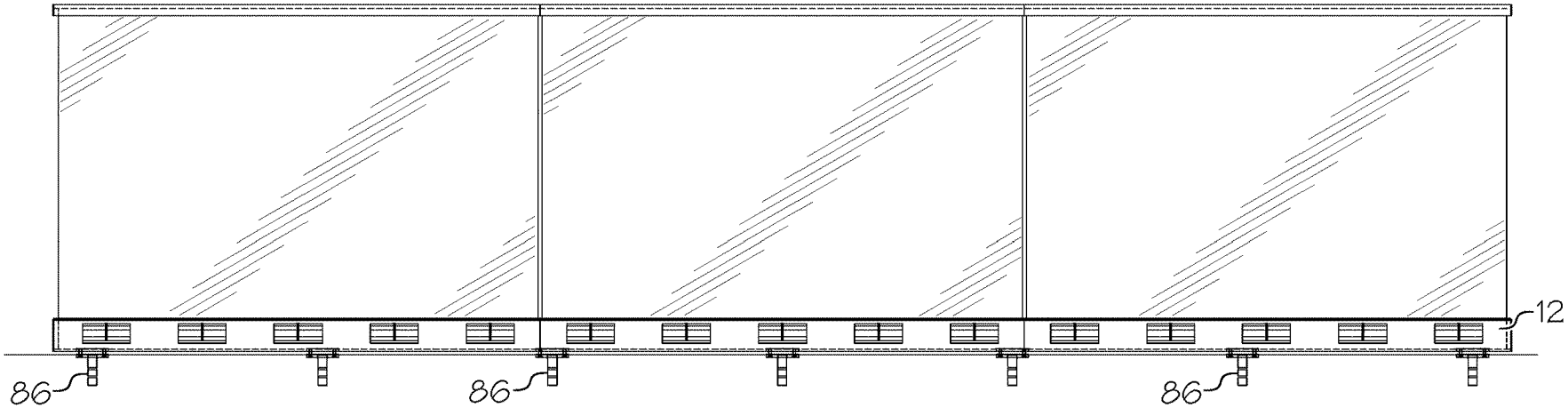
FIG. 8A is a side plan view of the glass railing system for installation on a balcony in accordance with the preferred embodiment of the instant invention.
Figure 8B:
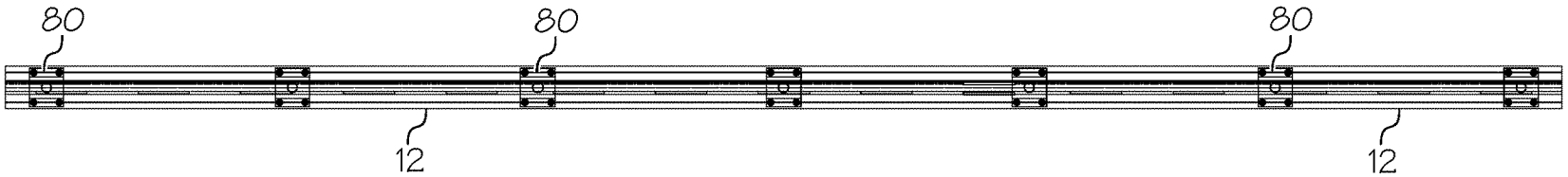
FIG. 8B is a bottom plan view of the glass railing system shown in FIG. 8A.
Figure 9:
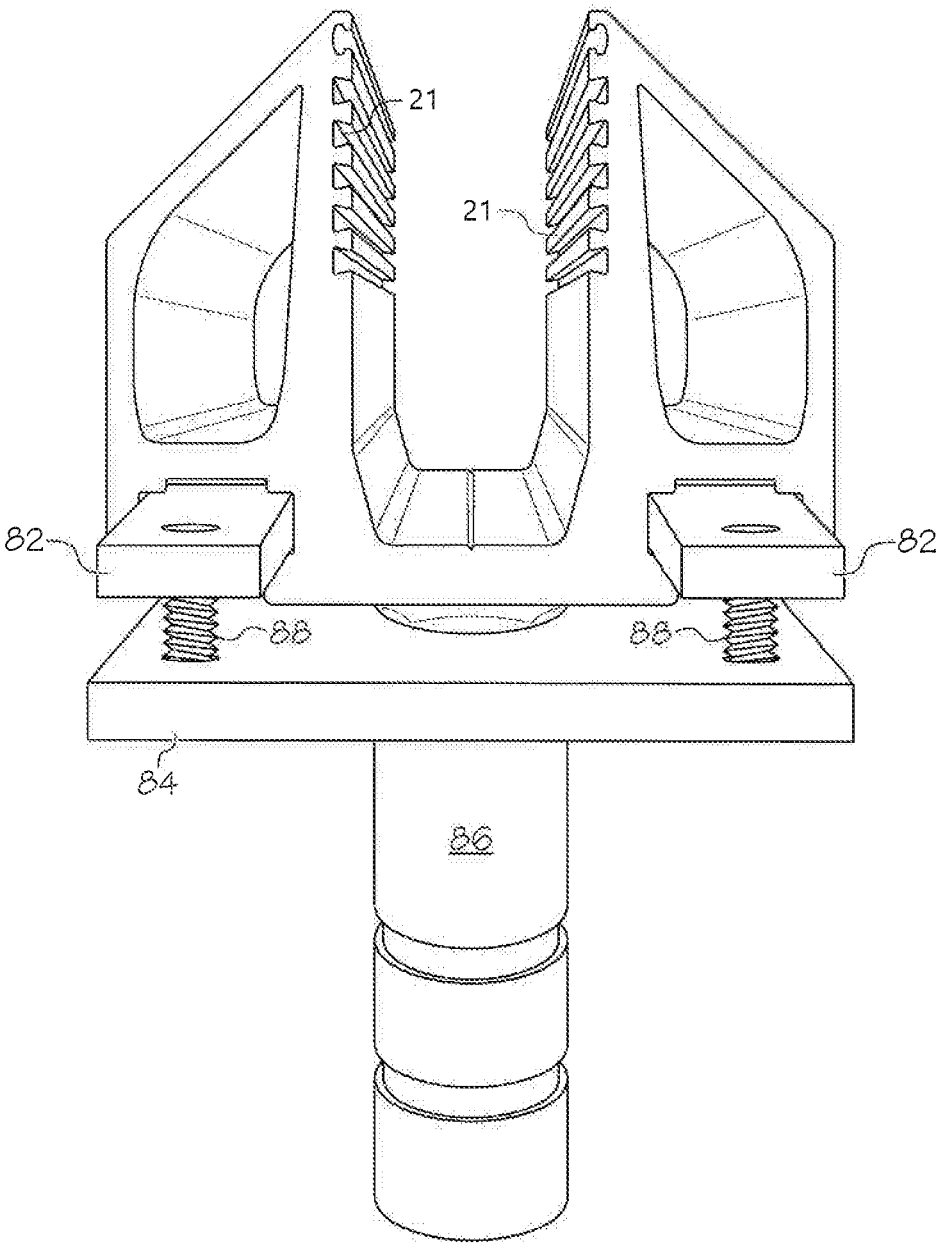
FIG. 9 is a perspective view of the of the glass railing system showing the insertion using the sliding anchor rod assemblies in accordance with the preferred embodiment of the instant invention.
Figure 10:
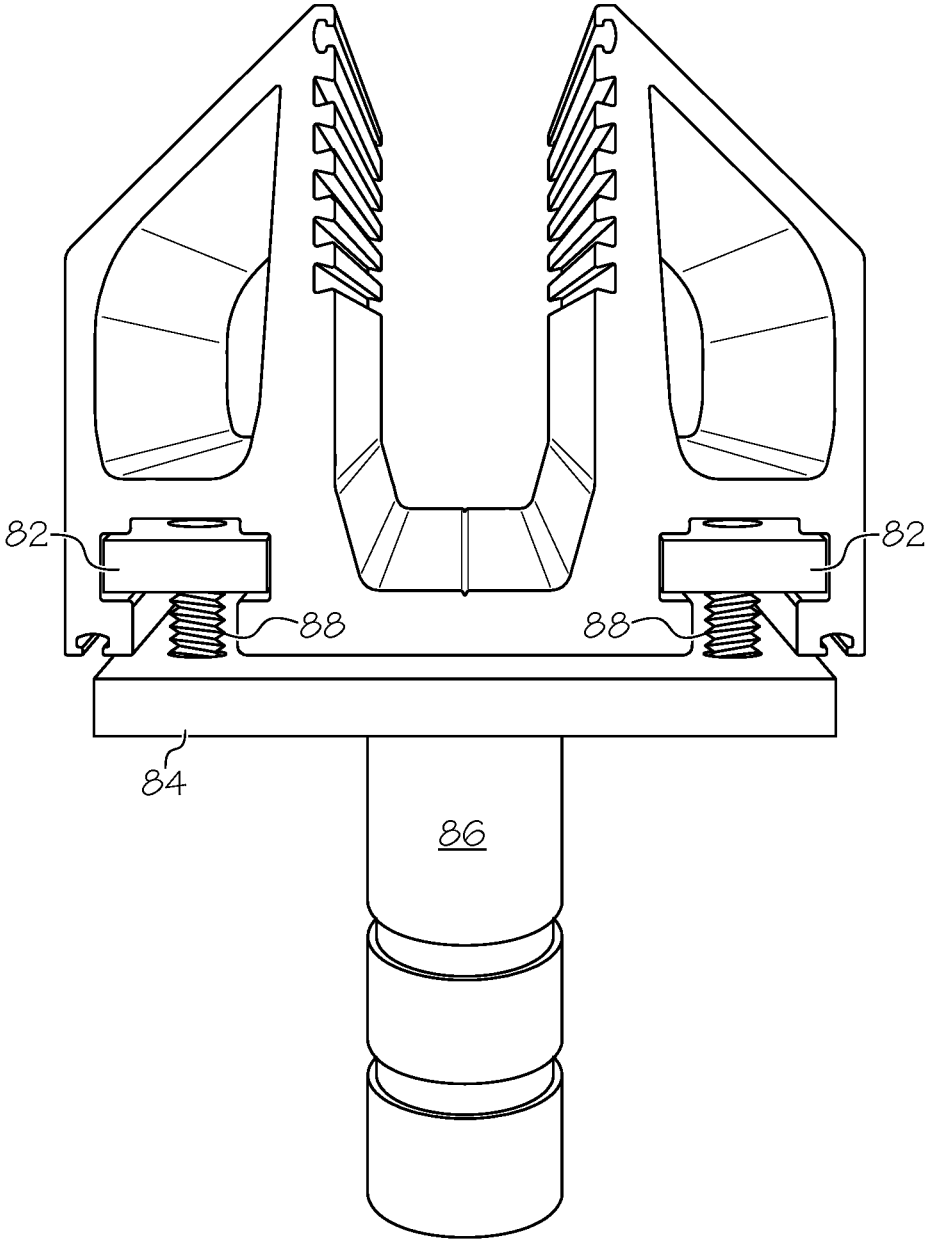
FIG. 10 is an alternative perspective view of the of the glass railing system showing the insertion using the sliding anchor rod assemblies in accordance with the preferred embodiment of the instant invention.
Figure 11:
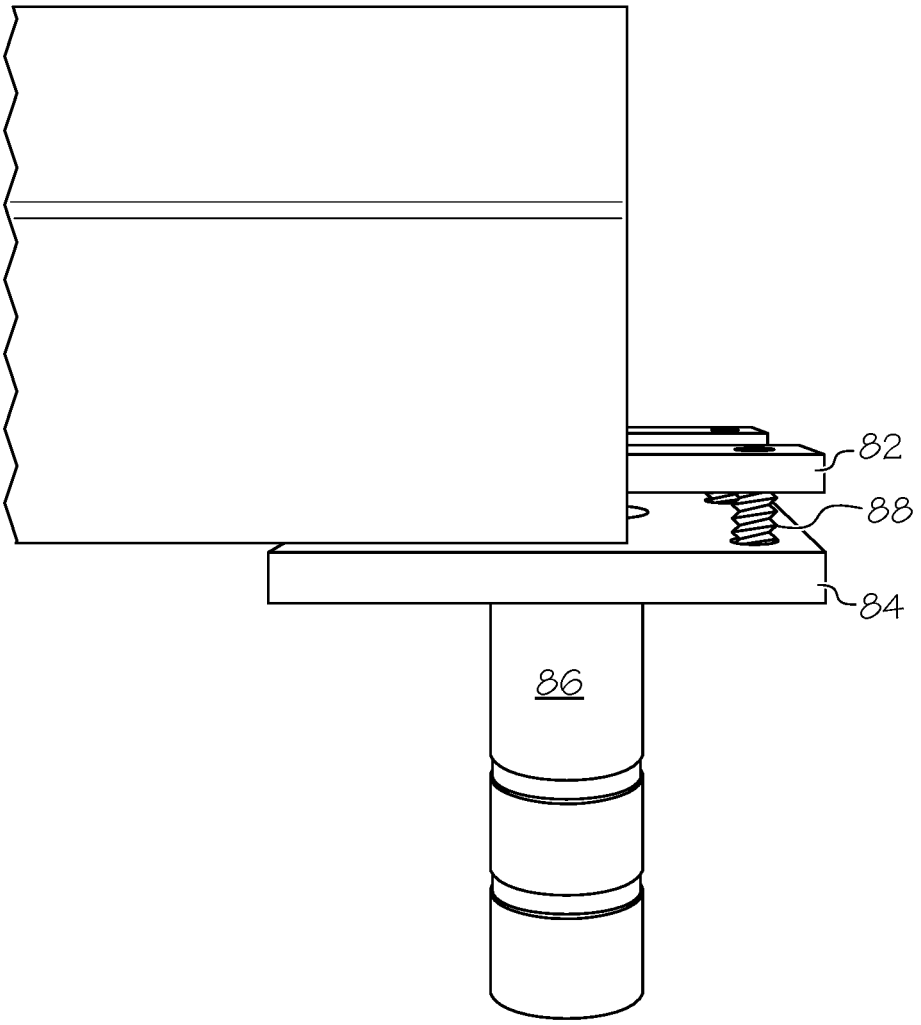
FIG. 11 is side perspective view of the of the glass railing system showing the insertion using the sliding anchor rod assemblies in accordance with the preferred embodiment of the instant invention.
Figure 12:
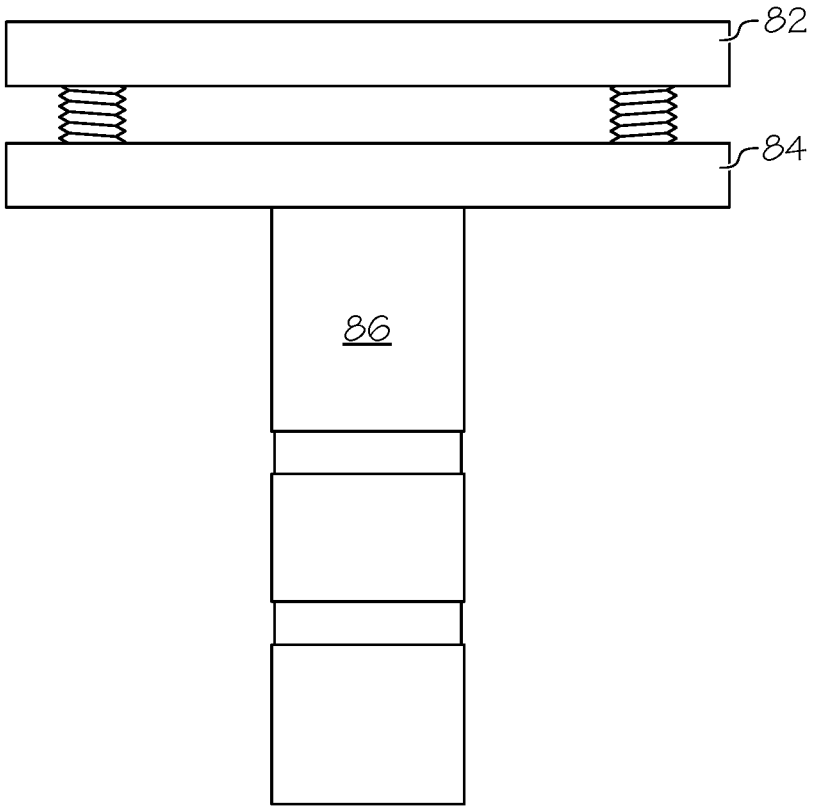
FIG. 12 is a side plan view of the sliding rod assembly in accordance with the preferred embodiment of the instant invention.

The instant invention 10 may also include skirt receiving channels 25, 27, a skirt 60 and, or at least one glass panel 50. The keyways 22, 32 comprise continuous slots that extend along the length of the base 12. The improved sliding anchor post assembly 80 improves the uniform distribution of structural support, as well as the tension, compressive loads and rotational forces to meet specific wind loads realized along the base, glass panels and anchors. The glass railing anchor system 10 takes advantage of the tensile strength of the anchor assemblies 80 by staggering and spacing them to provide multiple lines of resistance. If one area of a building has higher wind loads, the spacing between the anchors 80 can be easily and quickly reduced in order to resist the higher wind loads. The anchor spacing is also adjusted to prevent contact with reinforcing bars in the concrete substrate, which avoids damage to the bars. The anchor posts 86 are set in high strength epoxy FM 90, as shown in FIGS. 2 & 5, which provides for a water proof anchor point and eliminates the stresses that traditionally used expansion anchors create. The anchors are also strategically placed so they are not visible from normal view.

Figure 3:
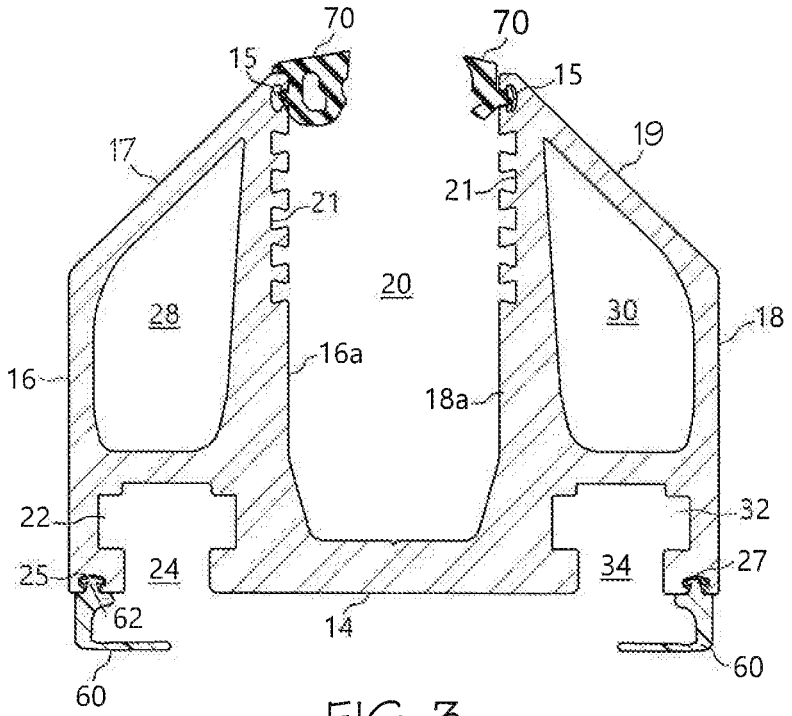
FIG. 3 is a cross sectional side view of the glass railing base in accordance with the preferred embodiment of the instant invention.
Figure 4:
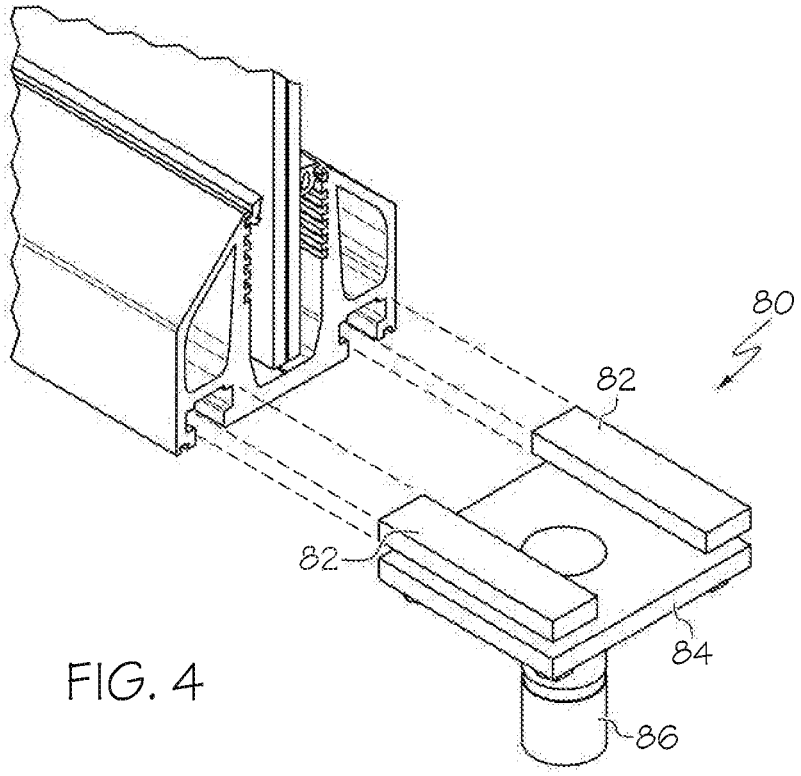
FIG. 4 is an exploded perspective view of the glass railing system showing the insertion using the sliding anchor rod assemblies in accordance with the preferred embodiment of the instant invention.

Still referring to FIGS. 1-12, the elongated extruded base 12 defines the hollow walls 16, 18, the wall channels 28, 30, respectively, and the anchor keyways 22, 32. The hollow walls 16, 18 eliminate unnecessary weight making the base 12 easier to move, set and anchor. With reference to FIGS. 3 & 5, the gasket channel 15 is defined in the interior surface 16*a*, 18*a* of the walls 16, 18, respectively, and extends continuously along the length of the walls 16, 18. The gasket channels 15 slidably receive and support a gasket 70 on each side of the base 12 to provide a decorative finished trim that hides the epoxy adhesive glazing set material, or polyurethane, cementitious, mechanical or alternative anchoring material/device. The gasket 70 preferably comprises a vinyl extruded material. The walls 16, 18 are separated and joined by a center base 14 which forms the floor of the glass panel receiving channel 20 and an inside section of the keyways 22, 32. The bottom surface of the base 12 below the walls 16, 18 may define skirt channels 25, 27, respectively, extending continuously along the length of the base 12 for supporting a skirt 60 on each side of the base 12, as shown in FIG. 5. The skirt channels 25, 27 receive a flange 62 projecting from the upper side of the skirt 60 for a tongue-and-groove fit. The skirt 60 disguises unlevel slab conditions or surface depressions and enhances aesthetic appearance by hiding the base drainage space when installed. The base 12 is secured to a concrete substrate with the height adjustable anchor assemblies 80 that slide into the slots 22, 32, secure the base and allow for adjustment of railing height, positioning of the anchors 80 and leveling which obviates the need to use unsightly leveling shims. Each slot 22, 32 defines an opening 24, 34, respectively, for passing the elongated rails 82 of the anchor assemblies 80, as particularly shown in FIGS. 4, 9

The post anchor assembly 80 components, plate, rails, post and hardware are preferably comprised of stainless steel (SS). The central posts 86 are secured and set in a high strength epoxy, such as two part high strength epoxy, cementitious grout, or other alternative anchoring material, and mixed with sand filler in holes drilled in the concrete substrate. These dimensions may vary without departing from the scope and spirit of the instant invention 10.

With reference to FIGS. 2, 3 and 5, the glass panels 50 are secured in the base channel 20. A setting block 31 may be inserted and set in the base channel 20 on the floor 14 of the channel 20. The interior walls of the base channel 20 include a plurality of bonding channels 21 along each side for enhancing the bonding between the channel walls 16*a*, 18*a* and bonding agent, such as high strength epoxy, polyurethane, cementitious, mechanical or alternative anchoring material/device. Once a glass panel 50 is inserted and set in the channel 20, gaps between the panel 50 and inner walls 16*a*, 18*a* of the channel 20 are filled with an anchoring material device as mentioned above. In an alternative embodiment, the glass panels 50 may be secured in the base channel 20 by a tapered wedge fit or alternate anchoring system. The glass panels 50 preferably comprise a range from ½ to 1 inch monolithic or laminated/tempered glass. The thickness of the glass panels 50 and width of the base channel 20 may vary without departing from the scope and spirit of the instant invention 10. Alternatively, in this system, the glass panel can be substituted with an alternative panel system such as a polycarbonate, solid, perforated, or waterjet/laser cut metal panel, or the like.

With reference to FIGS. 2, 6A-6D, and 7A-7D the glass panels 50 may include decorative caps 52 & 53 snapped to the upper edge of the panels 50. Caps 52 & 53 comprise various shapes as shown in the Figures. Geometric designs, shapes, dimensions, thicknesses, openings and profiles are matters of choice and aesthetics. The use of caps is optional and mostly for aesthetic purposes but also provide protection to and from the top edge of the glass panels 50.

The instant invention 10 provides a wide base 12 with the opposing elongated keyways 22, 32 that accommodate two elongated rails 82 of each post anchor assembly 80, which increase the resistance to shearing wind forces such as those in HVHZ's and the structural integrity of the base anchor 12. The slots 22, 32 also allow the anchors 80 to be moved which facilitates pre-coating and staggering, relocating and adjusting the anchor bolt assemblies 80 without requiring drilling in the field when an anchor must be relocated to avoid contact with rebar in the concrete and allow closer placement to the concrete substrate's edges. The extruded design also reduces weight and offers flexibility in designing the base in various shapes and reduces costs in manufacturing. With reference to FIG. 3, the side walls 16, 18 comprise low profile angled top edges 17, 19, respectively, which may also comprise rounded edges, that makes the glass panels 50 appear to float while facilitating water runoff. The design of the glass railing anchor system 10 facilitates the placement of the anchors in epoxy and closer to the edges of the concrete substrate without inducing undesirable compressive loads within the concrete to maintain their tensile pullout strength and prevent the fracturing and spalling of the concrete. The use of epoxy also serves to waterproof newly drilled holes and prevents water intrusion into the center of the slab. An additional advantage of the instant invention is that it does not require posts or caps that could obstruct the view through a glass railing and facilitates the use of glass having varying degrees of thickness.

In regard to the instant improved post anchor assembly 80, several substantial enhancements and significant structural support factors are achieved. This new anchor system offers additional benefits in construction by allowing anchor holes to be pre-sleeved with removable styrofoam blocks as opposed to being drilled in place after casting of reinforced concrete structure resulting in efficiencies in the speed of installation, improve safety for the installation crew, and most importantly, eliminating damages to integral reinforcing steel within the reinforced concrete structure. This new system and anchor assemblies ensures the preservation of the foundation of newly constructed projects providing for a longer service life of the related materials. Additionally, in the event that field installed pre-sleeved Styrofoam inserts are misplaced, the new sliding anchor assembly is capable of being adjusted laterally to coincide with the actual field location of the pre-sleeved Styrofoam insert which may have shifted from the original planned location during the forming and pouring operations of the reinforced concrete structure. This improved system also eliminates the need for the drilling of numerous anchor holes, which leads to significant damage to the reinforcing steel within the concrete structures, which thereafter allows for the onset of damages due to premature deterioration.

The new anchor system also provides for much larger spans between the placement of anchor assemblies and posts, reducing the frequency of anchor holes and drilling. Reduced frequency also allows for avoiding damage or conflict with the reinforcing steel elements, and much more efficient installation by reducing the labor required due to less processes required for installation of, and requirement for, materials.

As referenced above, the anchor mounting plate reinforces the aluminum shoe base by providing a wider surface area of contact and acting as a bridge by way of clamping and preventing the lower surface of the aluminum shoe base from deforming or bending, resulting in increased bending resistance and the ability to remain rigid and structurally sound at higher wind forces and pressures. The new, significantly larger, central anchor post provides an improved structural support for the railings and base, and efficient use of materials in the manufacturing and installation process. The central anchor post configuration also provides for additional edge distance between the anchor assembly and the edge of the slab where edge reinforcement bars are typically located. This design also significantly increases section modulus and greater availability of higher yield materials offers greater resistance to deleterious bending resulting in much greater resistance to higher wind loads.

The instant invention has been shown and described herein in what is considered to be the most practical and preferred embodiment. It is recognized, however, that departures may be made therefrom within the scope of the invention and that obvious structural and/or functional modifications will occur to a person skilled in the art.

What is claimed is:

1. A glass railing anchor system for securing a glass railing to a concrete substrate, comprising:
- at least one glass panel;
- an elongated base member, said base member having means for receiving said glass panel;
- said base member further including at least one hollow wall member;
- said base member further including at least one keyway for receiving means for anchoring said base member;
- means for anchoring said base member, said means for anchoring said base member including an anchor assembly, said anchor assembly slidably engaging said keyway for selectively positioning and securing said base member;
- said anchor assembly including a mounting plate, and at least one elevated, elongated rail member;
- said anchor assembly further including a post member;
- said elongated, elevated rail member secured to said mounting plate;
- said post member centrally positioned and secured to said plate member; and
  - said post member for being secured to said concrete substrate.

2. The apparatus of claim 1 wherein said base member includes two hollow wall members, said wall members opposing one another on opposite sides of said glass panel.

3. The apparatus of claim 2 wherein the interior surfaces of said wall members form a portion of said means for receiving said glass panel.

4. The apparatus of claim 3 wherein said means for receiving said glass panel constitutes a channel formed by said interior surfaces of said wall members and a center base therebetween joining said wall members.

5. The apparatus of claim 4, wherein said base member, said hollow wall members and said center base constitute a unitary structure.

6. The apparatus of claim 5, wherein said base member includes two keyways, one said keyway formed about the bottom of each said wall member and integrally associated therewith;
- said anchor assembly including two elongated, elevated rail members secured to said mounting plate; and
- said elevated rail members slidably engaging said keyways for selectively positioning and securing said base member.

7. The apparatus of claim 1, wherein said mounting plate elevates said base member.

8. The apparatus of claim 1, wherein said keyway further includes means for drainage within said keyway.

9. The apparatus of claim 1, wherein said base member further includes means for receiving an aesthetic skirt about said base.

10. A glass railing anchor system for securing a glass railing to a concrete substrate, comprising:
- at least one glass panel;
- an elongated base member, said base member having an integral channel for receiving said glass panel;
- said base member further including at least one hollow wall member;
- said base member further including at least one keyway for receiving an anchor assembly;

at least one said anchor assembly for securing said base member;

said anchor assembly including at least one elevated, elongated rail member;

said elongated, elevated rail member slidably engaging said at least one keyway for selectively positioning and securing said base member;

said anchor assembly including means for elevating said base member above said concrete substrate; and said anchor assembly including a lower post member centrally positioned with respect to said base member for being secured to said concrete substrate.

11. The apparatus of claim 10, wherein said base member includes two hollow wall members, said wall members opposing one another on opposite sides of said glass panel.

12. The apparatus of claim 11, wherein said integral channel is formed by said two wall members and a center base therebetween joining said wall members.

13. The apparatus of claim 12, wherein said base member, said hollow wall members and said center base constitute a unitary structure.

14. The apparatus of claim 13, wherein said base member includes two keyways, one said keyway formed about the bottom of each said wall member and integrally associated therewith;

said anchor assembly including two elongated, elevated rail members secured to a mounting plate; and said elongated, elevated rail members slidably engaging said keyways for selectively positioning and securing said base member.

15. A glass railing anchor system for securing a glass railing to a concrete substrate, comprising:

at least one glass panel;

an elongated base member, said base member having an integral channel for receiving said glass panel;

said base member further including a plurality of hollow wall members, said wall members forming said integral channel;

said base member further including a plurality of keyways, one said keyway formed about the bottom of each said wall member for receiving a plurality of anchor assemblies;

a plurality of anchor assemblies for securing said base member;

each said anchor assembly including a plurality of elevated, elongated rail members;

each said elongated, elevated rail member slidably engaging one of said plurality of keyways for selectively positioning and securing said base member;

at least one said anchor assembly including means for elevating said base member above said concrete substrate; and each said anchor assembly including a lower centrally positioned post member for being secured to said concrete substrate.

16. The apparatus of claim 15, wherein said base member and said hollow wall members constitute a unitary structure.

* * * * *